US005880581A

United States Patent [19]

Yang

[11] Patent Number: 5,880,581

[45] Date of Patent: Mar. 9, 1999

[54] AC OR BIDIRECTIONAL CIRCUIT UTILIZING UNIPOLAR CAPACITORS

[76] Inventor: Tai-Her Yang, No. 32 Lane 29, Taipin St., Si-Hu Town, Dzan-Hwa, Taiwan

[21] Appl. No.: 986,936

[22] Filed: Dec. 8, 1997

[51] Int. Cl.[6] ..... G05F 1/40

[52] U.S. Cl. ..... 323/288; 330/304

[58] Field of Search ..... 333/18, 28 R; 323/288; 363/39; 327/552; 361/398; 330/304

[56] References Cited

U.S. PATENT DOCUMENTS 3,700,817 10/1972 Garcia et al. ..... 370/488

4,555,754 11/1985 Hennevin ..... 363/132

5,302,922 4/1994 Heidermann et al. ..... 333/18

*Primary Examiner*—Shawn Riley

*Attorney, Agent, or Firm*—Bacon & Thomas, PLLC

[57] ABSTRACT

A bipolar circuit, i.e., a circuit in which currents can flow in two directions, utilizes unipolar capacitors, i.e., capacitors in which the capacitance depends on the direction of current flow. The unipolar capacitors are connected in parallel with diodes having the same polarities as the capacitors to which they are connected, and the diode/capacitor combinations are connected in series so that the polarities of the respective combinations are mutually opposite.

7 Claims, 1 Drawing Sheet

AC OR BIDIRECTIONAL CIRCUIT UTILIZING UNIPOLAR CAPACITORS

BACKGROUND OF THE INVENTION

Conventional electrolytic capacitors have a single preferred discharge direction and can therefore usually be used only in single direction or unipolar DC circuits. For circuits having different polarities, such as AC or bipolar circuits, capacitors are usually required to have equal or nearly equal capacities in each direction.

SUMMARY OF THE INVENTION

The invention allows unipolar capacitors to be used in an AC or bipolar equalizing or non-equalizing circuit by parallel combining a diode and a unipolar capacitor having the same polarities to form a first component, which is series combined with a second component having an opposite polarity, the second component being similarly constituted by parallel combining a diode and another unipolar capacitor having the same polarities. The capacitor of the second component can have the same or different capacity as that of the capacitor in the first component, to thereby provide a composite capacitive component that can be used in AC or bipolar equalizing or non-equalizing circuits and provide a variety of different effects depending on the relative capacities of the two unipolar capacitors.

DETAILED DESCRIPTION OF THE PREFERRED EMBODIMENTS

Figure 1:
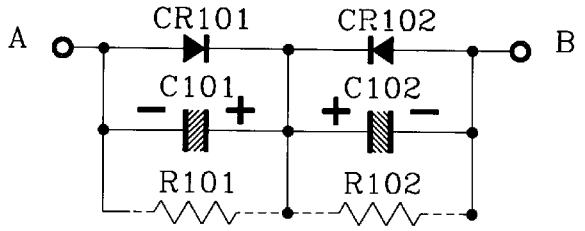
FIG. 1 is a schematic circuit diagram of a preferred embodiment of the invention.

FIG. 1 is a basic schematic circuit diagram of the invention, in which capacitors C101, C102 are unipolar capacitors which can perform unipolar discharge, (or bipolar capacitors connected to perform unipolar discharge), wherein each unipolar capacitor can be of the same capacity of a different capacity. Diodes CR101, CR102 can include a variety of rectifier components with unidirectional electricity conducting functions. Diode CR101 is parallel combined in the same polarity with unipolar capacitor C101 to form a first component, while the second diode CR102 is parallel combined in the same polarity with unipolar capacitor C102 to form a second component. The first component and the second component are connected in series with opposite polarities to form a two-terminal composite capacitive component that may be used in an AC or bipolar circuit to provide equalizing or non-equalizing effects depending on the relative capacities of the two unipolar capacitors. Shunt resistors R101, R102 are optional installed components which are connected in parallel between the terminals of the respective capacitors C101 and C102 for absorbing residual electricity in the unipolar capacitors.

In operation, when terminal A of the series-connected opposite-polarity first component and second component is at a high voltage level and terminal B is at a low voltage level, the unipolar capacitor C102 is charged by current flowing through the diode CR101, while the unipolar capacitor C101 is in a discharged state. When terminal B of the series-connected opposite-polarity first component and second component is at a high voltage level while terminal A is at a low voltage level, the unipolar capacitor C101 is charged by current flowing through the diode CR102, while the unipolar capacitor C102 is in a discharged state. If the two terminals of each of the unipolar capacitors C101, C102 are individually parallel connected with discharge resistors R101, R102, residual electricity in the unipolar capacitors C101 and C102 can be discharged.

Figure 2:
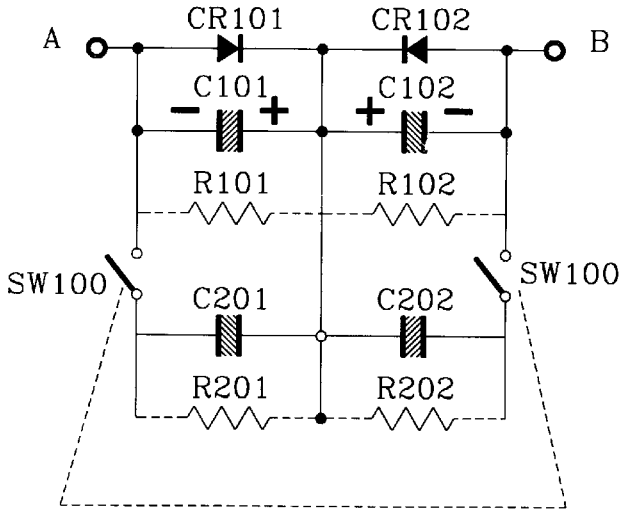
FIG. 2 is a schematic circuit diagram a second preferred embodiment of the invention illustrating a two stage type circuit capable of switching capacities.

The second preferred embodiment of the invention is similar to the first preferred embodiment, but further includes a two-stage circuit structure with switchable capacities. As shown in FIG. 2, capacitors C101, C102 are again constituted by unipolar capacitors which can perform unipolar discharge, or bipolar capacitors connected to perform unipolar discharge, wherein each unipolar capacitor can be of the same capacity or different capacity. Similarly, diodes CR101, CR102 are again made up of rectifier components with unidirectional electricity conducting functions, with the diode CR101 being parallel combined in the same polarity with the unipolar capacitor C101 to form the first component, and the second diode being parallel combined in the same polarity with the unipolar capacitor C101 to form the second component. In addition, as in the first embodiment, the first component and the second component are series combined with opposite polarities to form a two-terminal composite component that could be used in an AC or bipolar equalizing or non-equalizing circuit, with optional shunt resistors R101, R102 being parallel combined between the terminals of respective capacitors C101 and C102 for discharging residual electricity in the unipolar capacitors.

Unlike the first preferred embodiment, the circuit of this embodiment, further includes unipolar capacitors C201, C202 made up of unipolar capacitors which can perform unipolar discharge, or bipolar capacitors connected for unipolar discharge, wherein each unipolar capacitor can be of the same capacity or different capacity, and shunt resistors R101, R102 connected in parallel between the terminals of respective capacitors C201 and C202 for discharging residual electricity in the unipolar capacitors.

Unipolar capacitor C201 is optionally parallel combined with the shunt resistor R201 to constitute the third component, while the unipolar capacitor C202 is optionally parallel combined with shunt resistor R201 to constitute the fourth component, with the third component and fourth component being series combined to have opposite polarities. The first composite component made up of the series-connected first component and second component and the second composite component made up of the seires-connected third component and fourth component are connected at the series combining point of the unipolar capacitors C101, C102, and the series combining point of the unipolar capacitors C201, C202, while the two terminals of the two two-terminal composite components are controlled by the switch SW100 such that when the switch SW100 is closed (ON), the unipolar capacitors C101 and C201 are parallel combined in the same polarities, while the unipolar capacitor C101 and C202 are similarly parallel combined in the same polarities; and when the switch SW100 is opened (OFF), then the first component and second component are individually operated.

Figure 3:
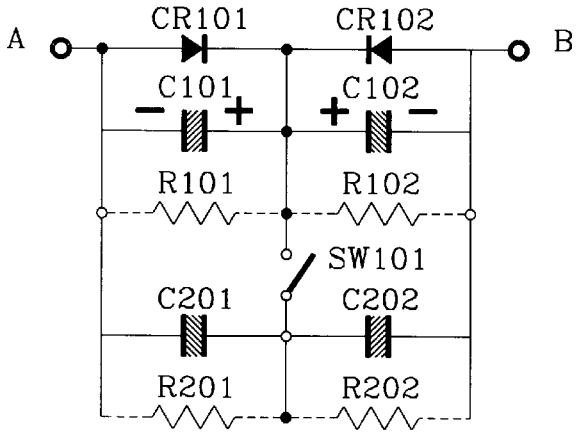
FIG. 3 is a schematic circuit diagram of a third preferred embodiment of the invention in which the two dual-terminal composite components are parallel combined in the same polarities and a switch is installed between the series combining point of unipolar capacitors C101, C102 and the series combining point of unipolar capacitors C201, C202.

Alternatively, as shown in FIG. 3, both terminals of each of the two two-terminal composite components may be parallel combined in the same polarities. In this embodiment, a switch SW101 is installed between the series combining point of the unipolar capacitors C101, C102 and the series combing point of the unipolar capacitors C201, C202, so that the terminals of each of the two-terminal composite components are parallel combined in the same polarities. As a result, when the switch SW101 is closed (ON), the unipolar capacitors C101 and C201 are parallel combined as are the unipolar capacitors C102 and C202, and when the switch SW101 is opened (OFF), then the unipolar capacitors are each individually operated.

Figure 4:
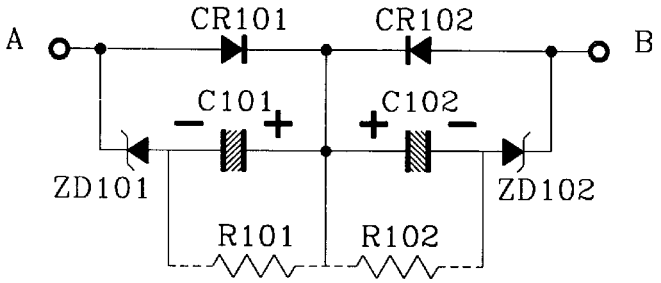
FIG. 4 is a schematic circuit diagram of a fourth preferred embodiment of the invention in which the circuit includes zener diodes for reverse voltage protection.

In a fourth preferred embodiment of the invention, terminals of the two unipolar capacitors series combined in reverse polarities can be respectively further series combined with zener diodes ZD101, ZD102, as shown in FIG. 4. As a result, the relationship between the unipolar capacitor C101 and the zener diode ZD101 is such that when the capacitor is charged the zener diode ZD101 is conductive in the current direction in the manner of a normal diode so that the zener diode can prevent the unipolar capacitor C101 from being damaged, in case the unipolar capacitor is subjected to a reverse voltage drop created by current through the diode CR101 which is parallel combined with the unipolar capacitor C101 in the same polarity. The zener diode ZD102 has the same functions as that of the unipolar capacitor C102 and diode CR102. If the power capacity is larger, either zener diode can be further replaced by a solid state power circuit unit with the same functions.

In the various embodying examples of the invention, the two unipolar capacitors are series combined with opposite polarities, and can have the same or different capacities, to provide a variety of different effects when they are operated with power sources of different polarities or AC power.

I claim:

1. A circuit having two terminals, said circuit being a bipolar circuit, i.e., a circuit in which currents can flow in two directions between the two terminals, comprising:

a first component comprising a first unidirectional capacitor and a first diode connected in parallel with the first unipolar capacitor, said first diode and the first unipolar capacitor having a mutually same first polarity;

a second component comprising a second unipolar capacitor and a second diode connected in parallel with the second unipolar capacitor, said second diode and second unipolar having a mutually same second polarity, wherein said first and second components are connected in series between said terminals such that said first and second polarities are opposite.

2. A circuit as claimed in claim 1, wherein said first and second unipolar capacitors have a mutually same capacitance such that current flowing in either of said two directions will encounter the same capacitance.

3. A circuit as claimed in claim 1, wherein said first and second unipolar capacitors have mutually different capacitances such that a current flowing in a first of said two directions will encounter a different capacitance than a current flowing in a second of said two directions.

4. A circuit as claimed in claim 1, further comprising a first shunt resistor connected in parallel with said first unipolar capacitor and said first diode, and a second shunt resistor connected in parallel with said second unipolar capacitor and said second diode, said first and second shunt resistors being arranged to discharge residual current in respective said first and second unipolar capacitors.

5. A circuit as claimed in claim 4, further comprising a third unipolar capacitor connected in parallel with a third resistor to form a third component having first and second ends, and a fourth unipolar capacitor connected in parallel with a fourth resistor to form a fourth component having first and second ends, said first ends of said third and fourth components being connected to each other and said second ends of said third and fourth components being connected by means of a switch to said first and second terminals.

6. A circuit as claimed in claim 4, further comprising a third unipolar capacitor connected in parallel with a third resistor to form a third component having first and second ends, and a fourth unipolar capacitor connected in parallel with a fourth resistor to form a fourth component having first and second ends, said first ends of said third and fourth components being connected to each other and said second ends of said third and fourth components being connected to said first and second terminals, said mutually connected first ends of the third and fourth components being connected to a common node between said first and second components by means of a switch.

7. A circuit as claimed in claim 4, further comprising at least one zener diode connected between one of said terminals and one of said unipolar capacitors, said zener diode having a same polarity as the one of said unipolar capacitors.

* * * * *